US006969169B2

(12) United States Patent
Tanaami et al.

(10) Patent No.: US 6,969,169 B2
(45) Date of Patent: Nov. 29, 2005

(54) RECORDING APPARATUS

(75) Inventors: Yasufumi Tanaami, Tokyo (JP); Shoichi Kan, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 145 days.

(21) Appl. No.: 10/660,622

(22) Filed: Sep. 12, 2003

(65) Prior Publication Data

US 2004/0067089 A1 Apr. 8, 2004

(30) Foreign Application Priority Data

Oct. 7, 2002 (JP) ..... 2002/293638

(51) Int. Cl.[7] ..... B41J 29/13

(52) U.S. Cl. ..... 347/108; 347/138; 347/152; 347/170; 347/222; 400/691; 400/693; 346/145

(58) Field of Search ..... 347/108, 138, 347/152, 170, 222; 400/691, 693; 346/145; B41J 29/13

(56) References Cited

U.S. PATENT DOCUMENTS 4,703,953 A * 11/1987 Woods ..... 462/32
5,423,529 A * 6/1995 Saito et al. ..... 271/127
5,443,320 A * 8/1995 Agata et al. ..... 400/715
5,831,656 A * 11/1998 Chosa ..... 347/108
5,880,754 A 3/1999 Niikura et al.
6,033,067 A 3/2000 Kakizaki et al.
6,317,313 B1 * 11/2001 Mosgrove et al. ..... 361/680
6,507,408 B2 1/2003 Iwasaki et al.
6,523,929 B2 2/2003 Kan et al.
6,536,864 B2 3/2003 Kan
6,848,685 B2 * 2/2005 Katsuyama ..... 271/162

FOREIGN PATENT DOCUMENTS

JP 2001356539 A * 12/2001 ..... G03G 15/00

* cited by examiner

*Primary Examiner*—Manish Shah
*Assistant Examiner*—Leonard Liang
(74) *Attorney, Agent, or Firm*—Fitzpatrick, Cella, Harper & Scinto

(57) ABSTRACT

A recording apparatus is provided in which a space can be secured on a desk without performing a troublesome operation, and penetration of dust or foreign matter into a main body can be prevented when the apparatus is not used, and a sheet jam caused by closing of a sheet-discharge-port cover does not occur when the apparatus is used. In the apparatus, a magnet unit is provided at a sheet feeding cover covering a sheet feeding opening, and a metal member is provided at a sheet-discharge-port cover for covering a sheet discharge port. By attraction of the metal member of the sheet-discharge-port cover by the magnet unit of the sheet feeding cover, and a locked state is provided, to provide a shell structure. Linked with opening of the sheet feeding cover, the sheet-discharge-port cover is automatically opened by its own weight. A DC jack is disposed at a right side of the printer main body, and an I/F (interface) connector is disposed within a detachable side cover.

5 Claims, 17 Drawing Sheets

RECORDING APPARATUS

BACKGROUND OF THE INVENTION

1. Field of the Invention

The present invention relates to the configuration of a housing of a printer.

2. Description of the Related Art

There exist portable printers in which, instead of performing printing by individually inserting sheets, continuous printing can be performed by mounting a plurality of sheets. In such a printer, a cover of a printer main body is sometimes utilized as a tray for mounting sheets (for example, refer to U.S. Pat. No. 6,507,408).

FIG. 11 is a perspective view illustrating a non-use state or a portable state of such a printer.

A sheet feeding cover 2 is provided so as to cover the upper surface of a printer main body 1 in a state of being rotatable around a rotation axis 2*a*. An I/F (interface) connector 3 for performing data exchange by being connected to an external apparatus is provided at a side 1*b* of the printer main body 1. A sheet discharge opening 1*e* where a sheet on which printing has been completed is discharged from the inside of the printer main body 1 is provided at a front 1*a*.

FIG. 12 is a perspective view illustrating a state of use of the printer shown in FIG. 11. By being opened by rotating around the rotation axis 2*a*, the sheet feeding cover 2 operates as a tray for mounting sheets 4. In the non-use state shown in FIG. 11, the sheet feeding cover 2 covers a sheet feeding opening 1*g*. The mounted sheets 4 are individually separated by a separation mechanism from the sheet feeding opening 1*g* provided at the upper surface 1*f* of the printer main body 1. The separated sheet is fed to a recording portion by a conveying mechanism. After a printing operation by a recording mechanism, the sheet is discharged by a conveying mechanism from the sheet discharge opening 1*e* provided at the front 1*a* (the above-described mechanisms are within the printer main body 1, and are not illustrated). An access cover 5 is provided immediately below the sheet feeding cover 2, so as to allow exchange of an ink tank, processing during a sheet jam, and the like. An operation unit 6 is also provided at the upper surface 1*f* of the printer main body 1 that is the same surface as a surface where the access cover 5 is provided, so that various operations for the printer can be performed and a state can be displayed. In this printer, the sheet feeding cover 2 is utilized as a sheet tray by opening the sheet feeding cover 2 during the use of the printer. Since the sheet feeding cover 2 is closed when the printer is carried, penetration of dust or foreign matter from the sheet feeding opening 1*g* into the printer main body 1 when the printer is carried is prevented.

FIG. 13 is a perspective view of the printer shown in FIG. 11, as seen from the back of the printer. FIG. 13 illustrates a state in which a connection cable 8 is connected to the I/F connector 3 provided at the side 1*b* of the printer main body 1, and a connection cable 9 from a commercial power supply (not shown) is connected to a DC Jack 7 provided at a back 1*d* of the printer main body 1. When intending to secure a space on a desk by reducing the occupied area of the printer main body 1 (in this case, equal to the projected area of the sheet feeding cover 2) in a state in which cables and the like are inserted as in this case, the occupied area is reduced by installing the printer in a state in which, as shown in FIG. 14, the front 1*a* where the cables and the like are not inserted is made a surface of installation, or in a state in which, as shown in FIG. 15, another side 1*c* facing the side 1*b* is made a surface of installation.

FIG. 16 is a perspective view illustrating a conventional non-use state (or a portable state) of another printer.

A sheet feeding cover 2 is provided so as to cover the upper surface of a printer main body 1 in a state of being rotatable around a rotation axis 2*a*. A sheet-discharge-port cover 10 is provided at a front 1*a* so as to be rotatable around a rotation axis 10*a*. An I/F connector 3 for performing data exchange by being connected to an external apparatus is provided at a side 1*b* of the printer main body 1.

FIG. 17 is a perspective view illustrating a state of use of the printer shown in FIG. 16. By being opened by rotating around the rotation axis 2*a*, the sheet feeding cover 2 operates as a tray for mounting sheets 4. In the non-use state shown in FIG. 16, the sheet feeding cover 2 covers a sheet feeding opening 1*g*. By opening of the sheet-discharge-port cover 10 by rotating around the rotation axis 10*a*, a sheet discharge opening 1*e* is exposed. The mounted sheets 4 are individually separated by a separation mechanism from the sheet feeding opening 1*g* provided at an upper surface 1*f* of the printer main body 1. The separated sheet is fed to a recording portion by a conveying mechanism. After a printing operation by a recording mechanism, the sheet is discharged by a conveying mechanism from the sheet discharge opening 1*e* provided at the front (the above-described mechanisms are within the printer main body 1, and are not illustrated). An access cover 5 is provided immediately below the sheet feeding cover 2, so as to allow exchange of an ink tank, processing during a sheet jam, and the like. An operation unit 6 is also provided at the upper surface 1*f* of the printer main body 1 that is the same surface as a surface where the access cover 5 is provided, so that various operations for the printer can be performed and a state can be displayed. This printer is carried by closing the sheet feeding cover 2 and the sheet-discharge-port cover 10. When using the printer, the sheet feeding cover 2 is utilized as a sheet tray by opening the sheet feeding cover 2 and the sheet-discharge-port cover 10, and the sheet 4 on which printing has been completed is discharged from the inside of the printer by exposing the sheet discharge opening 1*e*. Thus, penetration of dust or foreign matter from the sheet feeding opening 1*g* and the sheet discharge opening 1*e* into the printer main body 1 is prevented.

In the printer of the first type, preparation for printing is completed only by opening the sheet feeding cover when using the printer. However, when carrying or stocking the printer, since the sheet discharge opening is not covered, penetration of dust or foreign matter into the printer main body cannot be prevented, whereby the operation of the printer may become abnormal.

In the printer of the second type, since both of the sheet feeding opening and the sheet discharge opening are covered by the respective covers, penetration of dust or foreign matter into the printer main body can be substantially prevented. However, when using the printer, both of the sheet feeding cover and the sheet discharge-port-cover must be opened. If printing is performed without opening the sheet-discharge-port cover, there is the possibility that a printed sheet will become jammed within the printer.

When intending to place the printer in a state in which the side, the back or the like is made a surface of installation in order to secure a space on a desk when the printer is not used, or to store the printer in a same state, the cables and the like are present in space to become an obstacle and provide an awkward appearance. If the cables and the like are detached, it is necessary to again insert them when using the printer, thereby causing a troublesome operation. Furthermore, since the DC jack and the I/F connector are disposed separately at the back and at the side, respectively, it is necessary to detach the cable from the DC jack when placing the printer in a state in which the back of the printer is placed downward.

SUMMARY OF THE INVENTION

It is an object of the present invention to provide a recording apparatus in which, when the recording apparatus is not used, it is possible to secure a space on a desk without performing a troublesome operation and prevent penetration of dust or foreign matter into the main body, and when the recording apparatus is used, a sheet jam due to closing of a sheet-discharge-port cover does not occur.

According to one aspect, the present invention which achieves the above-described object relates to a recording apparatus including a main housing that includes a supply opening for supplying a recording medium to be subjected to recording by recording means into a main body, and a discharge opening from which the recording medium is discharged outside of the apparatus, a first openable/closable cover member for covering the supply opening, and a second openable/closable cover member for covering the discharge opening. When the first cover member is opened, the second cover member is opened by being linked with the first cover member. When the first cover member and the second cover member are closed, an end portion of the first cover member and an end portion of the second cover member face each other.

As described above, the recording apparatus of the invention includes the openable/closable first cover member and second cover member for covering the supply opening and the discharge opening, respectively, of the main housing. When the first cover member is opened, the second cover member is opened by being linked with the first cover member. When the first cover member and the second cover member are closed, the first member and the second cover member constitute a shell structure. That is, in the recording apparatus of the invention, if the first cover member is opened when the recording apparatus is used, the second cover member is opened by being linked with the first cover member. Hence, the problem that printing is performed in a state in which only the first cover member is opened and the second cover member is not opened, resulting in a jam of a printed recording medium by the second cover member, does not occur. Furthermore, by providing the shell structure in which the sheet feeding opening and the sheet discharge opening are covered by the first and second cover members, respectively, penetration of dust or foreign matter from the sheet feeding opening and the sheet discharge opening into the main body when the apparatus is not used can be prevented.

According to another aspect, the present invention relates to a sheet processing apparatus including a supply opening for supplying a sheet into a main body, a discharge opening for discharging the sheet subjected to processing within the main body outside of the apparatus, a first openable/closable cover member for covering the supply opening, and a second openable/closable cover member for covering the discharge opening, and connection means for maintaining, when both of the first cover member and the second cover member are closed, a state in which the first cover member and the second cover member are closed by connecting the first cover member and the second cover.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings.

Figure 1:
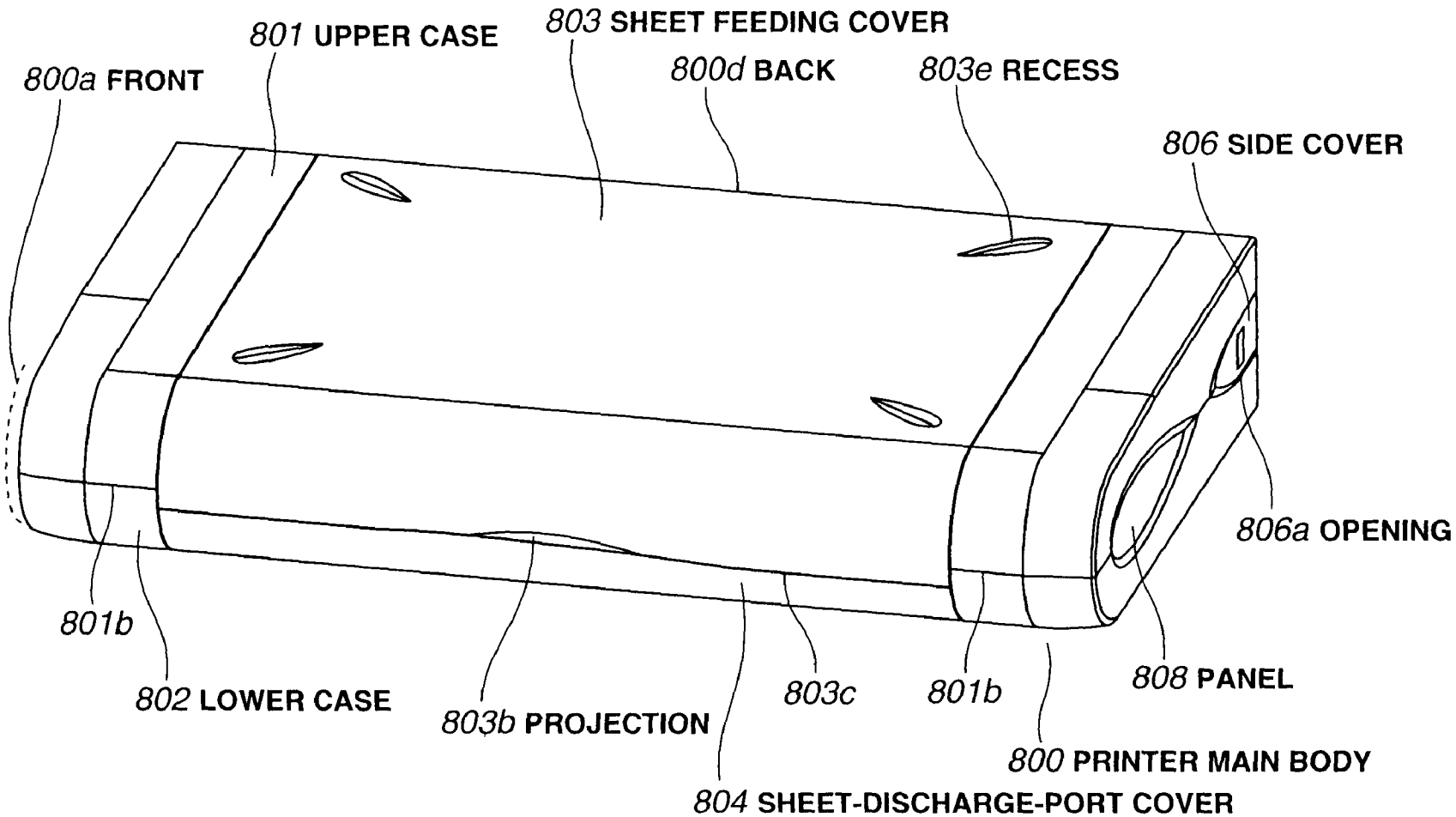
FIG. 1 is a perspective view illustrating an external appearance of a printer according to an embodiment of the present invention in a non-use state or a portable state.

FIG. 1 is a perspective view illustrating an external appearance of a main body 800 of a printer, serving as a recording apparatus according to the embodiment of the present invention, as seen from an upper right front direction. An armor member includes an upper case 801 and a lower case 802 that are fitted at a center 801*b* in the direction of the thickness, a sheet feeding cover 803, serving as a first cover member covering the upper case 801, and a sheet-discharge-port cover 804, serving as a second cover covering a lower front portion of the printer main body 800. The sheet feeding cover 803 and the sheet-discharge-port cover 804 are connected by a locking mechanism (not shown, part of the mechanism will be described later) at a central portion, serving as connection means. A connection line 803*c* between the sheet feeding cover 803 and the sheet-discharge-port cover 804 is set at a portion lower than the center 801*b* of the printer main body 800 because of a reason to be described later. A manual handling projection 803*b* for opening the sheet feeding cover 803 when using the printer is provided at the sheet feeding cover 803. As shown in FIG. 1, a front 800*a* of the printer main body 800 has the shape of R so as to be easily held by hands when carrying the printer. Since the possibility of making another surface of the printer main body 800 a surface of installation is high when intending to store the printer main body 800 by holding the front 800*a* with hands, five surfaces other than the front 800*a* are planar. According to the above-described configuration, the printer main body 800 has an appearance of a so-called shell structure in which openings are covered. When the printer is vertically installed in this state, for example, by making a back 800*d* facing the R-shaped front 800*a* a surface of installation, penetration of dust or foreign matter into the printer main body 800 can be prevented.

Figure 2:
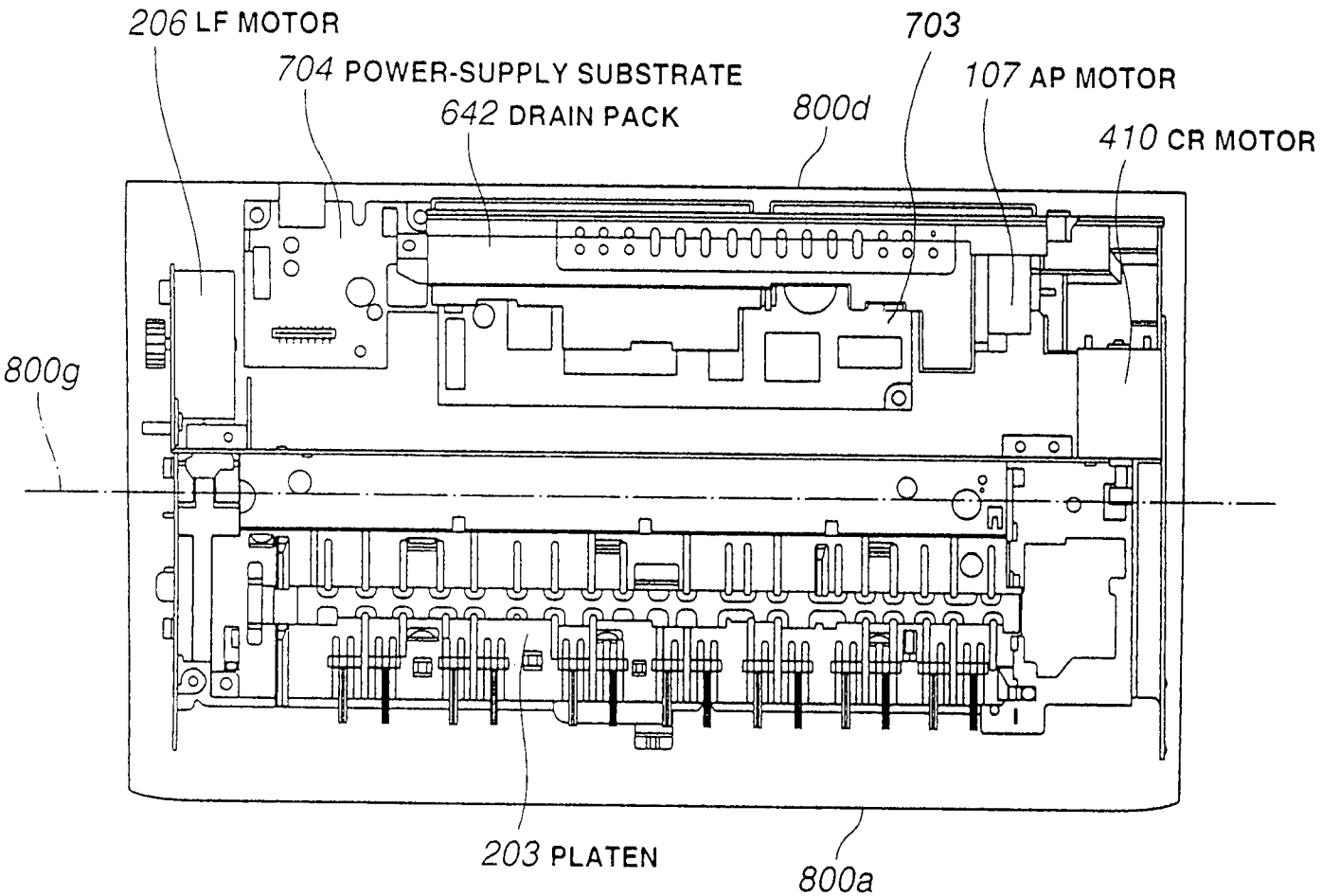
FIG. 2 is a perspective diagram illustrating part of internal components of the printer shown in FIG. 1.

FIG. 2 is a perspective diagram illustrating (part of) internal components of the printer main body 800, as seen from above. An AP motor 107 for performing switching between driving of a sheet feeding roller (not shown) for feeding a mounted sheet and driving of a recovery unit (not shown) for performing cleaning of a recording mechanism, or the like, an LF motor 206 for conveying a sheet during recording and sheet discharge, and a CR motor 410 for driving a carriage unit (not shown) mounting an ink-jet recording head, serving as recording means, are disposed at the back 800*d* side with respect to a substantial center 800*g* between the R-shaped front 800*a* of the printer main body 800 and the back 800*d* facing the front 800*a*. A drain pack 642 for holding waste ink discharged from the above-described recovery unit is also provided at the back 800*d* side, particularly near the back 800*d*, with respect to the center 800*g*. A main substrate 703 for controlling the printer main body 800, and a power-supply substrate 704 for supplying electric power are also disposed at the back 800*d* side with respect to the center 800*g*. A platen 203, the recovery unit, the carriage unit and the like are also disposed at the front 800*a* side with respect to the center 800*g*, as well as a space for scanning by the carriage unit. Since heavy components are disposed at the back 800*d* side with respect to the center 800*g*, the printer can be accommodated in a stable state when accommodating the printer by making the back 800*d* of the printer main body 800 a surface of installation. In this case, since the drain pack 642 accommodating waste ink is also positioned at a lower portion of the printer main body 800, waste ink enters the drain pack 642 by naturally flowing downward, so that the waste ink can be assuredly held.

Figure 3:
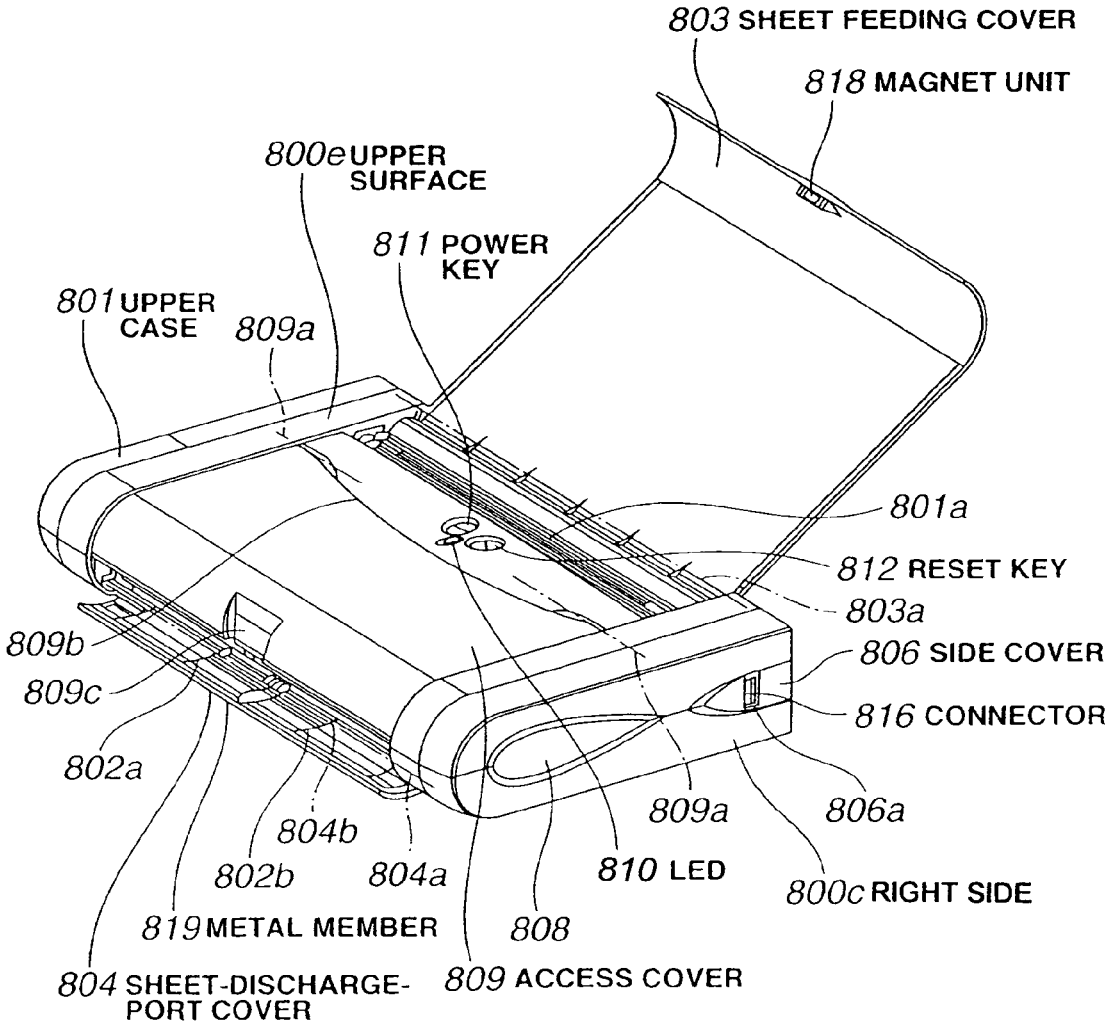
FIG. 3 is a perspective view illustrating an external appearance of the printer shown in FIG. 1 in a state of use.

FIG. 3 is a perspective view illustrating a state of use of the printer main body 800, as seen from an upper right front direction. In the state shown in FIG. 1, a sheet feeding opening 801*a* and a sheet discharge port 802*a* are covered with the sheet feeding cover 803 and the sheet-discharge-port cover 804, respectively, so that penetration of dust or foreign matter into the printer main body 800 is prevented. Attraction of a metal member 819 mounted on the sheet-discharge-port cover 804 onto a magnet unit 818 mounted on the sheet feeding cover 803 provides a locked state. Since the upper case 801 and the like other than the sheet feeding cover 803 and the sheet-discharge-port cover 804 are not locked, the printer main body 800 is automatically opened by linked movement of the sheet-discharge-port cover 804 by its own weight by releasing attraction by the magnet unit 818 by opening the sheet feeding cover 803. This mechanism has the role of preventing of a sheet jam that may occur if the sheet-discharge-port cover 804 is not opened during printing. Any other appropriate release means using a spring, an electric driving force or the like may be used instead of opening of the sheet-discharge-port cover 804 by its own weight, provided that the sheet-discharge-port cover 804 is automatically opened by being linked with opening of the sheet feeding cover 803.

The sheet feeding cover 803 and the sheet-discharge-port cover 804 are connected using a magnet, in order to open the sheet-discharge-port cover 804 by being linked with opening of the sheet feeding cover 803. Instead of using a magnet, any other mechanism, such as a method of locking the sheet feeding cover 803 and the sheet-discharge-port cover 804 using a hooking member, such as a pawl or the like, or a method of opening the sheet-discharge-port cover 804 using a motor or the like after detecting opening of the sheet feeding cover 803 with a sensor may be easily considered and adopted.

The sheet feeding cover 803 rotates around a rotation axis 803*a* with respect to the printer main body 800, and stops at a constant angle optimum for sheet feeding by a stopper (not shown), to support sheet feeding and improve accuracy in sheet feeding. The sheet-discharge-port cover 804 rotates around a rotation axis 804*a*, and rotation of the sheet-discharge-port cover 804 in a direction of opening is suppressed by contact of a projection 804*b* of the sheet-discharge-port cover 804 with a recess 802*b* provided in the lower case 802. The position of stop of the sheet-discharge-port cover 804 is set to a position where the sheet-discharge-port cover 804 does not contact a surface of installation of the printer main body 800 when installing the printer. By thus suppressing rotation of the sheet-discharge-port cover 804, it is possible to prevent generation of a sound and damage on an outer surface of the sheet-discharge-port cover 804 caused by contact with a surface of installation. An access cover 809 is provided immediately below the sheet feeding cover 803 so as to be rotatable around a rotation axis 809*a*, so that exchange of an ink tank, processing during a sheet jam, and the like can be performed. An operation unit is provided behind the access cover 809. An LED (light-emitting diode) 810 indicating the state of the printer main body 800, a power key 811 for turning on/off a power supply, and a reset key 812 for performing sheet feeding and resetting are disposed on the operation unit. The operation unit is disposed so as to cut a central portion on the rotation axis 809*a* of the access cover 809, and therefore the access cover 809 has a circular shape 809*b* so as to follow the shape of the operation unit. A recess 809*c* is provided at a front portion, in order to prevent interference with the magnet unit 818 provided at the sheet feeding cover 803, and allow easy opening when opening the access cover 809.

A side cover 806 is mounted at a right side 800*c* of the printer main body 800 in a state in which part of the side cover 806 extends to the back 800*d*, and access to an I/F connector 816 can be performed from an opening 806*a* provided in the side cover 806. According to such an arrangement, a change in the I/F connector 816 can be dealt with if a component in which the opening 806*a* of the side cover 806 is changed is prepared. That is, extension of product line-ups can be easily followed. A panel 808 is mounted on the side cover 806. If, for example, a product name different for each destination is printed on the panel 808, it is only necessary to change the panel 808. Accordingly, a component configuration in which each destination is flexibly dealt with can be realized with only a small increase in the cost.

Figure 4:
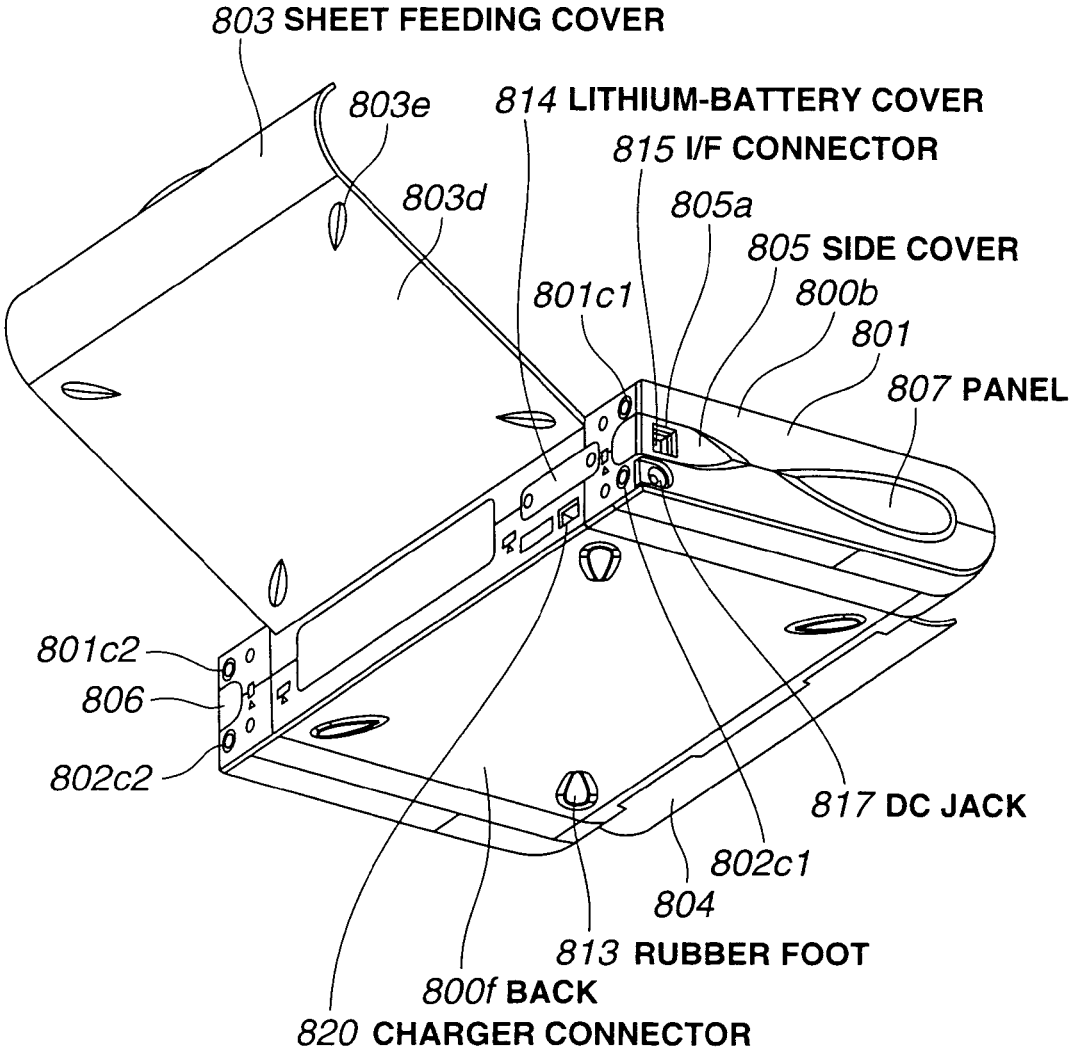
FIG. 4 is a perspective view illustrating the printer shown in FIG. 1 in the state of use, as seen from a diagonal direction in FIG. 3.

FIG. 4 is a perspective view illustrating the same state as in FIG. 3, as seen from a downward left back direction (a diagonal direction in FIG. 3). A side cover 805 is mounted at a left side 800*b* of the printer main body 800, in the same manner as at the right side 800*c*, in a state in which part of the side cover 805 extends to the back 800*d* of the printer main body 800, and access to an I/F connector 815 can be performed from an opening 805*a* provided in the side cover 805. A panel 807 is also provided, to provide a feature of symmetry of the product. These effects are the same as in the right side 800*c*, and therefore further description thereof will be omitted. A DC jack 817 is provided at the left side 800*b*, in order to allow connection of a commercial power supply (not shown). In contrast to the above-described I/F connectors 815 and 816, the DC jack 817 is disposed outside of the side cover 805. This is because the DC jack 817 is indispensable irrespective of a product line-up and destination, and need not necessarily be accommodated within the side cover 805, and for discriminating that the character of the DC jack 817 is different from the characters of the I/F connectors 815 and 816. However, when such consideration is unnecessary, it is, of course, possible to dispose the DC jack 817 within the side cover 805, although it depends on a space available within the printer main body 800.

A plurality of rubber feet 813 are disposed at a bottom 800*f*, serving as a surface of installation when the printer main body 800 is used. The material for the feet 813 is not limited to rubber, provided that it is elastic. For example, a resin may be used. Recesses 803*e*, whose number is the same as that of the rubber feet 813, having the same projected shape are formed at positions facing the rubber feet 813 in an upper surface 803*d* of the sheet feeding cover 803 that is on the same plane as an upper surface 800*e* of the printer main body 800 when the sheet feeding cover 803 is closed, in order to cause the user to recognize which surface is the upper surface by touching the surface, in addition to provide a feature of symmetry of the product.

At the back 800*d* of the printer main body 800, a lithium-battery cover 814 is provided so that a lithium battery can be detached and separately collected when rejecting the printer, as well as a charger connector 820 for connecting a battery charger 900 (to be described later) prepared as an optional component. An optional component is fixed with screws by using screw holes provided at at least one of pedestals 801*c*1, 801*c*2 and 802*c*2 provided at the printer main body 800. These pedestals protrude from the back 800*d* by a predetermined amount, so as to operate as so-called feet in order to prevent direct contact of the optional component with the printer main body 800 when mounting the optional component, and direct contact of a surface of installation with the printer main body 800 when accommodating the printer by making the back 800*d* a surface of installation.

Figure 5:
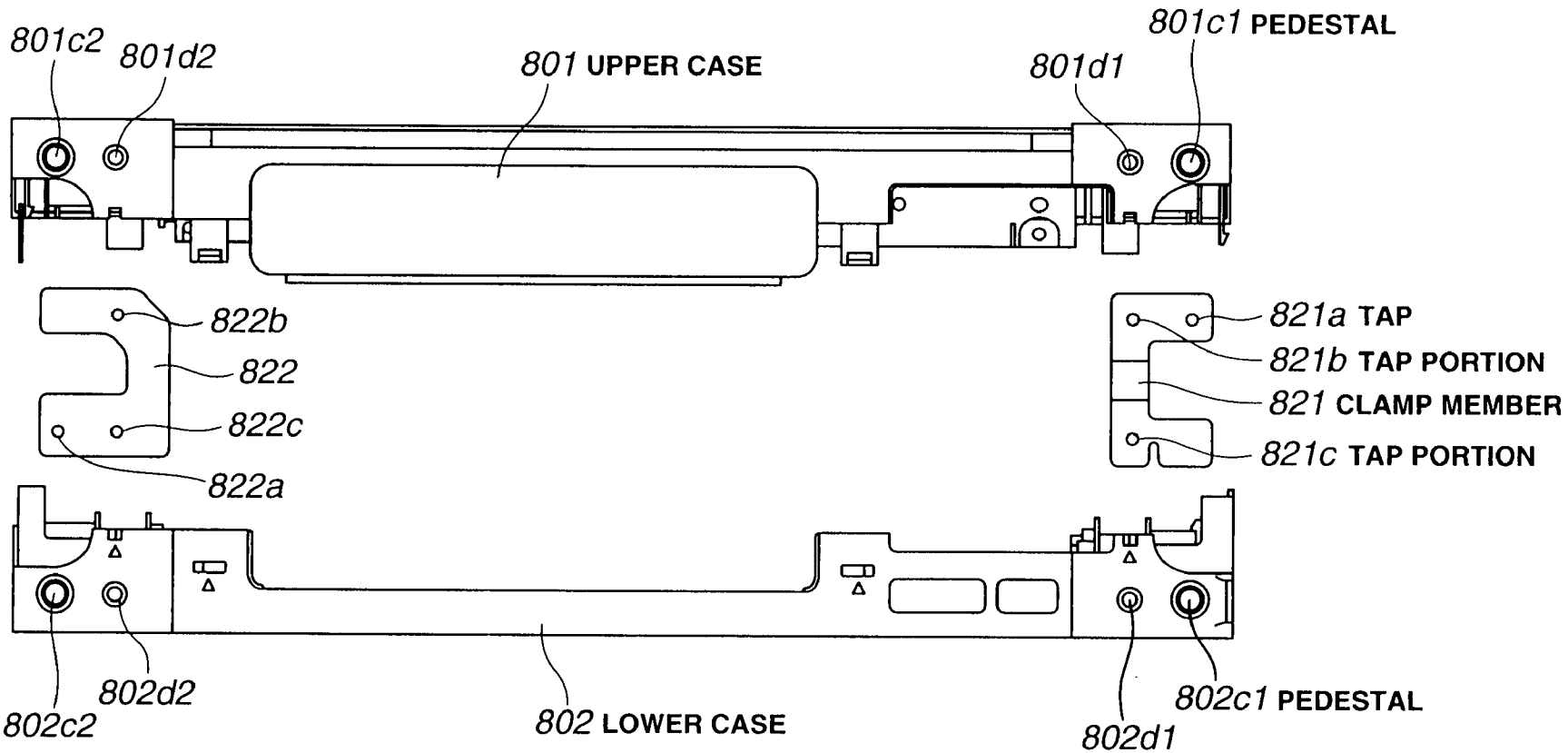
FIG. 5 is an exploded view illustrating an optional-member mounting unit of the printer shown in FIG. 1.

FIG. 5 is an exploded view of a member for mounting an optional component, as seen from the back of the member. Clamp members 821 and 822 for connecting the upper case 801 and the lower case 802 are disposed within the printer main body 800. As shown in FIG. 5, these clamp members have substantially a U shape. Tap portions 821*b* and 822*b* for screwing the upper case 801, and tap portions 821*c* and 822*c* for screwing the lower case 802 are provided at bottom portions of the clamp members 821 and 822, respectively. A tap 821*a* for screwing the optional component from the pedestal 801*c*1 at the upper case 801 side, and a tap 822*a* for screwing the optional component from the pedestal 802*c*2 at the lower case 802 side are provided at a distal end portion of the U-shaped clamp member 821, and at the other clamp member 822, respectively.

By thus screwing an optional component using two diagonally positioned ones of the four pedestals, balanced fixing can be performed. The U-shaped clamp members 821 and 822 extend to the pedestal 801*c*2 of the upper case 801 and the pedestal 802*c*1 of the lower case 802 that are not used. Accordingly, by providing the taps 821*a* and 822*a* at different distal end portions of the U shape, the pedestal 801*c*2 of the upper case 801 and the pedestal 802*c*1 of the lower case 802 can also be used for screwing the optional component.

That is, by providing the clamp members 821 and 822 in the above-described U shape, or in a shape so as to include all of the pedestal 801*c*1 of the upper case 801, and the pedestals 802*c*1 and 802*c*2 of the lower case 802, it is possible to provide a configuration in which various fixing methods can be flexibly dealt with only by changing tap positions without changing the outer shapes of the clamp members 821 and 822.

Figure 6:
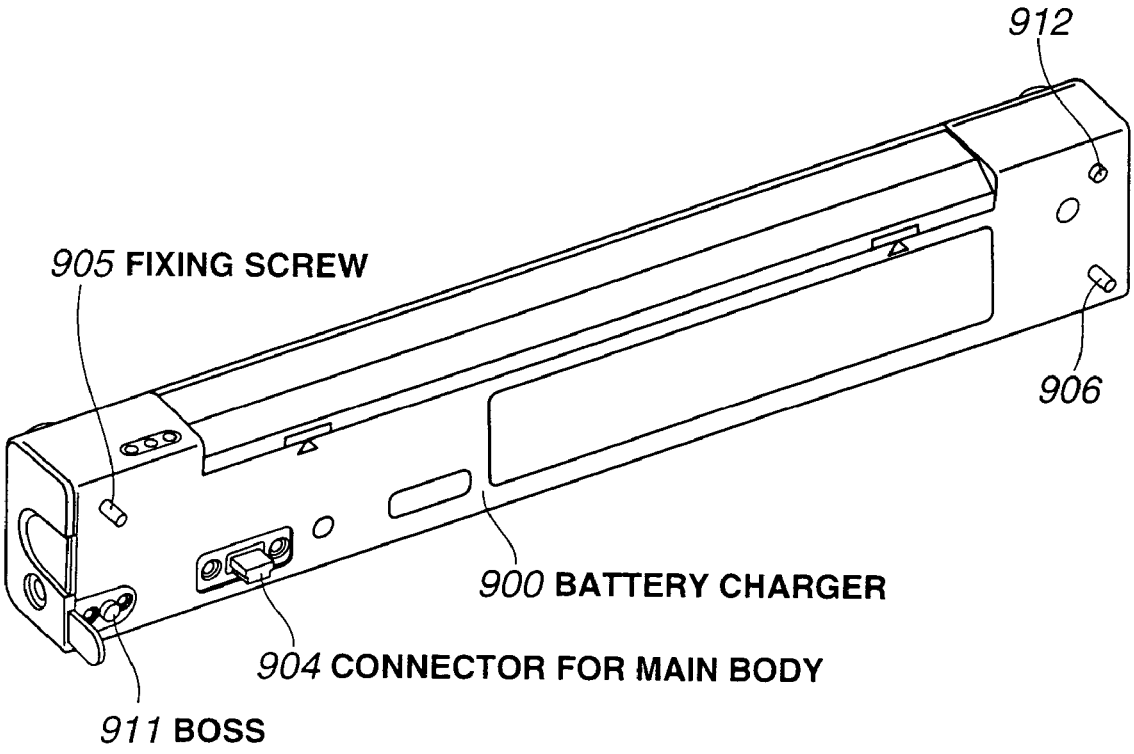
FIG. 6 is a perspective view illustrating a battery charger, serving as an option connected to the printer shown in FIG. 1.

FIG. 6 is a perspective view illustrating the battery charger 900 incorporating a battery (not shown), serving as an optional member, as seen from a connecting surface with the printer main body 800. A connector 904 for performing electric connection with the printer main body 800, and fixing screws 905 and 906 are disposed at a position facing the charger connector 820 shown in FIG. 4, and at positions facing the pedestal 801*c*1 of the upper case 801 and the pedestal 802*c*2 of the lower case 802 (the positions of the taps 821*c* and 822*c*) shown in FIG. 4, respectively, in order to fix the battery charger 900 to the printer main body 800. Bosses 912 and 911 are provided at positions facing the pedestal 801*c*2 of the upper case 801 and the pedestal 802*c*1 of the lower case 802 (a position where a tap is absent), respectively. By providing balance by performing fixing using diagonally positioned ones of the four pedestals as described above, and inserting and fitting the bosses 911 and 912 in remaining two pedestals, backlash with respect to the printer main body 800 is reduced, to realize tighter fixing.

Figure 7:
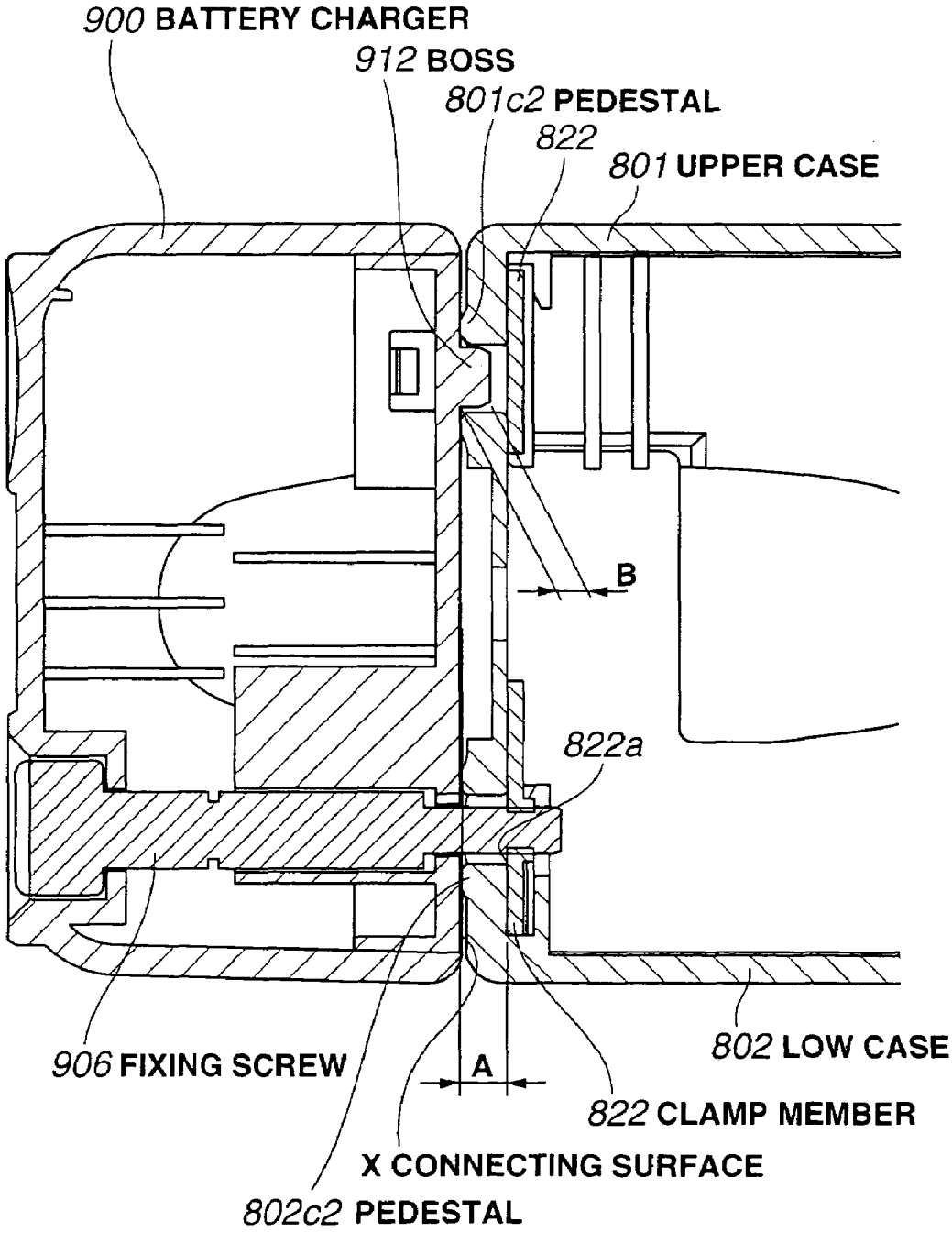
FIG. 7 is a partial side cross-sectional view illustrating a state of connection of the battery charger shown in FIG. 6 to the printer shown in FIG. 1.

FIG. 7 illustrates a state of connection of the battery charger 900 with the printer main body 800. FIG. 7 is a side cross-sectional view including a line connecting the fixing screw 906 and the boss 912 shown in FIG. 6. As shown in FIG. 7, the clamp member 822 is disposed with a constant interval A from a connecting surface X. The constant interval A is set to be deeper than the length of insertion B of the boss 912 of the battery charger 900, so that the boss 912 can be inserted without contacting the clamp member 822. The situation is the same for the fixing screw 906 side. That is, even if the relationship between the fixing screw 906 and the boss 912 is inverted, this change can be flexibly dealt with only by changing the position of the tap 822*a*, as described above.

Figure 8:
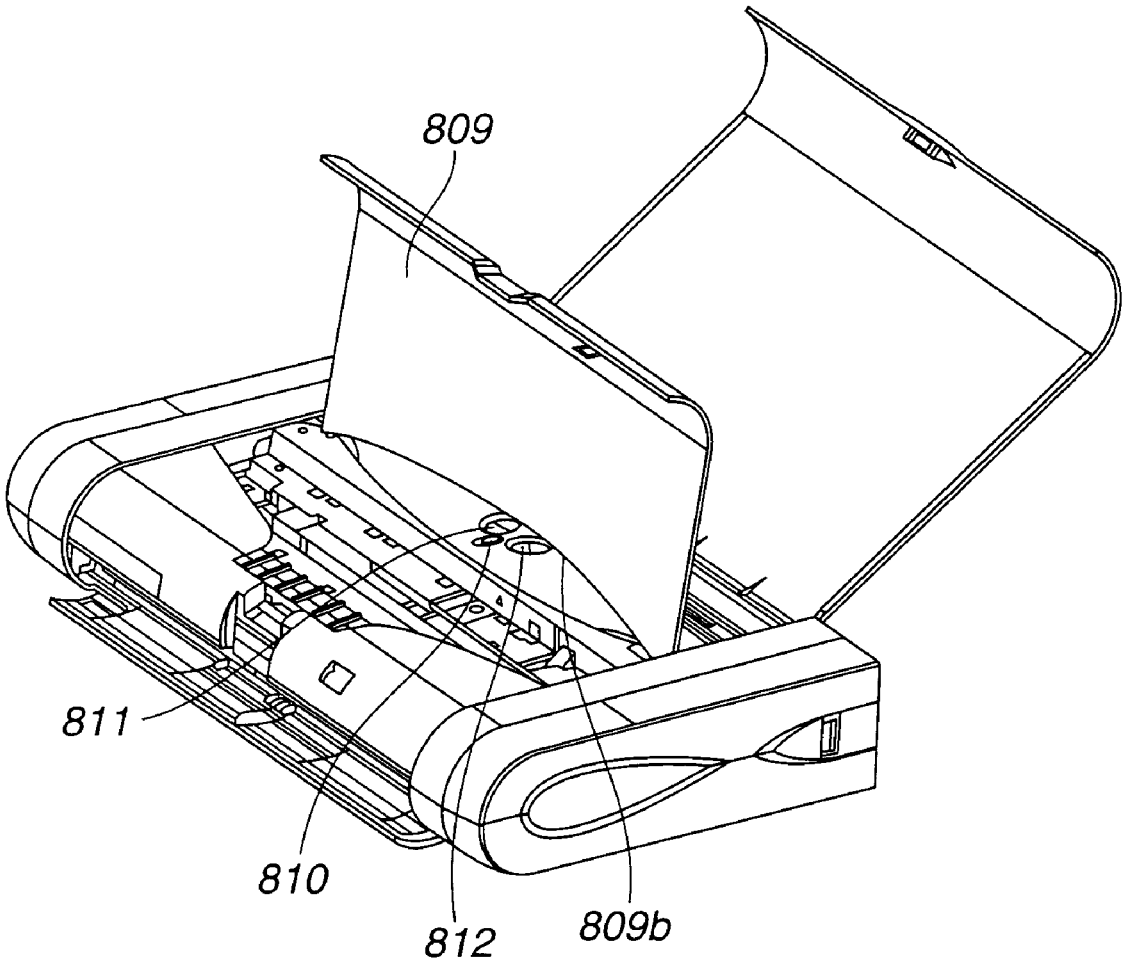
FIG. 8 is a perspective view illustrating a state in which an access cover is opened in a state of use of the printer shown in FIG. 1.

FIG. 8 illustrates a state in which the access cover 809 is opened from the state shown in FIG. 3. By the circular shape 809*b* of the access cover 809, a space for allowing visual recognition of the LED 810, the operation keys and the like on the operation is formed. Accordingly, in the sate in which the access cover 809 is opened, the state of the printer main body 800 can also be confirmed.

Figure 9:
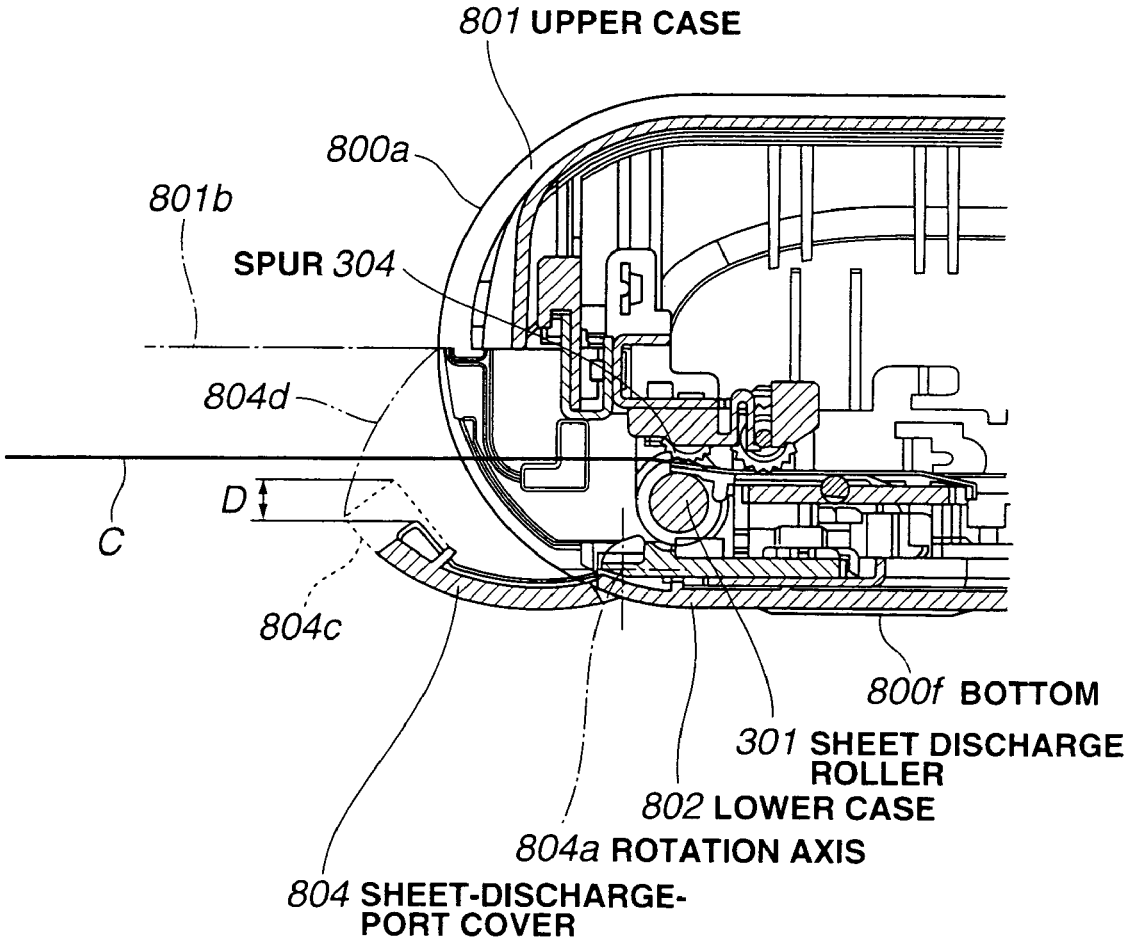
FIG. 9 is a partial side cross-sectional view illustrating a state in which a sheet-discharge-port cover of the printer shown in FIG. 1 is opened.

FIG. 9 is a side cross-sectional view illustrating a state in which the sheet-discharge-port cover 804 is opened. A printed sheet C is discharged by being grasped and conveyed by a sheet discharge roller 301 and a spur 304 urged by the sheet discharge roller 301. As described above, since the connection line 803*c* between the sheet-discharge-port cover 804 and the sheet feeding cover 803 is set lower than the center 801*b*, i.e., the connection portion between the upper case 801 and the lower case 802, a sufficient space is provided between the sheet C and the sheet-discharge-port cover 804, as shown in FIG. 9. If the connection line 803*c* between the sheet-discharge-port cover 804 and the sheet feeding cover 803 is set to the same plane as the center 801*b*, i.e., the connection portion between the upper case 801 and the lower case 802, the sheet-discharge-port cover 804 depicts a locus indicated by two-dot chain lines 804*d*. In this case, the sheet-discharge-port cover 804 is at a position indicated by broken lines 804*c*, so that the sheet-discharge-port cover 804 is closer to the sheet C by an amount D. Discharge of the sheet C is thereby hindered, thereby increasing the possibility of occurrence of a sheet jam. In the present invention, by setting the connection line 803*c* between the sheet-discharge-port cover 804 and the sheet feeding cover 803 lower than the center 801*b*, i.e., the connection portion between the upper case 801 and the lower case 802, a space with the sheet C is sufficiently secured in a state in which the sheet-discharge-port cover 804 is opened, thereby preventing occurrence of a sheet jam.

As shown in FIG. 9, the sheet-discharge-port cover 804 has a shape so as to follow the R-shaped front 800*a* of the printer main body 800, and the rotation axis 804*a* of the sheet-discharge-port cover 804 is provided near a portion where the R-shaped front 800*a* crosses the bottom 800*f* that is a surface of installation in a state of use. As a result, the center of gravity of the sheet-discharge-port cover 804 is closer to the front 800*a* of the printer main body 800 than the rotation axis 804*a*, thereby providing a weight balance so as to open the sheet-discharge-port cover 804 by its own weight when connection with the sheet feeding cover 803 is detached. As described above, since the sheet-discharge-port cover 804 has the R shape, it smoothly opens by its own weight without contacting a surface of installation, and the like.

Figure 10:
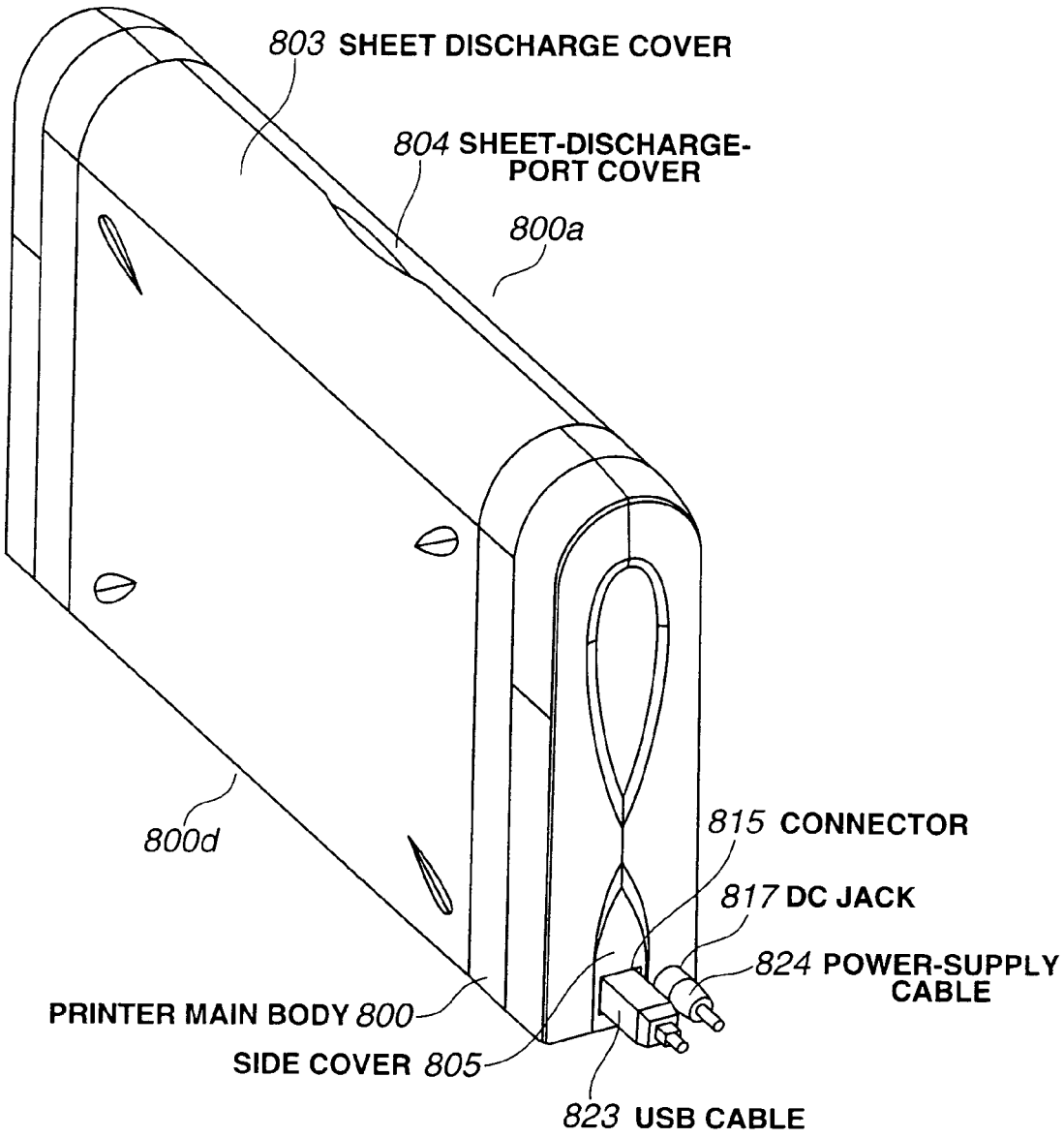
FIG. 10 is a perspective view illustrating the printer shown in FIG. 1 in a vertically stored state while inserting cables.
Figure 11:
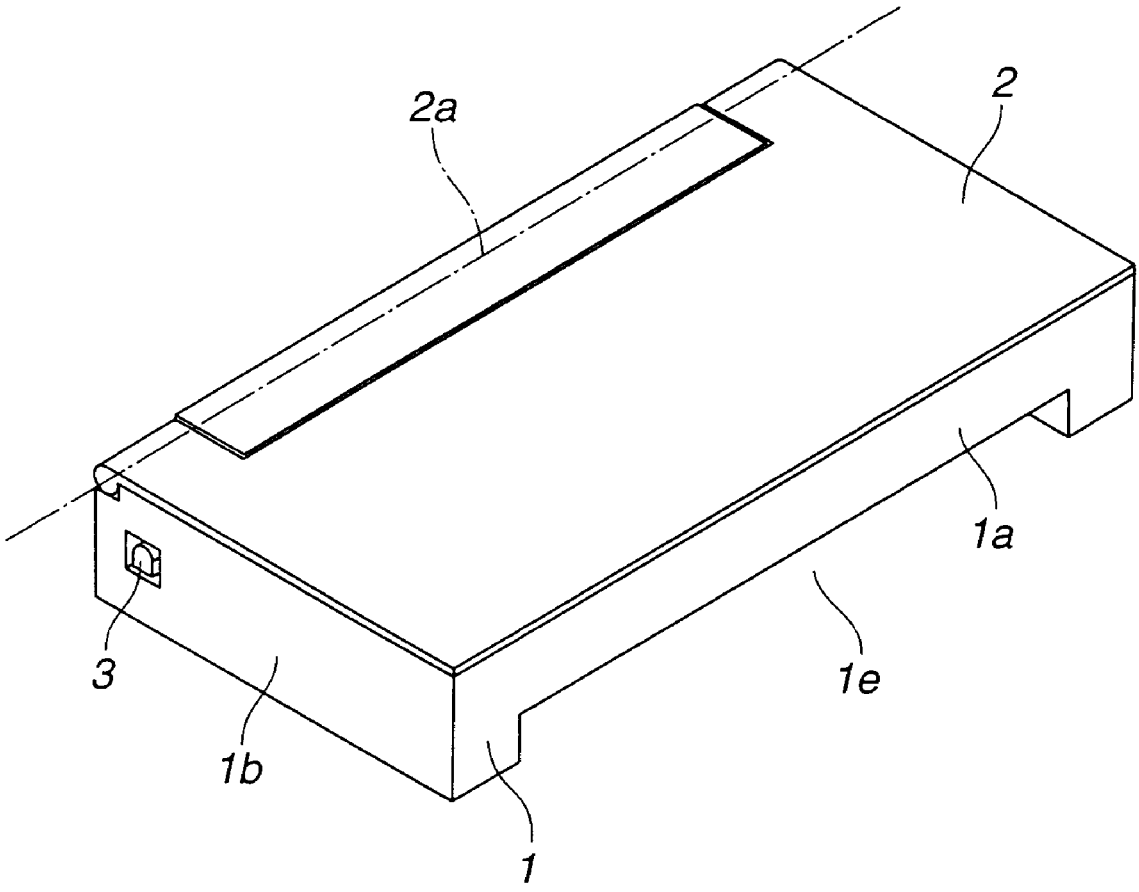
FIG.11 PRIOR ART
FIG. 11 is a perspective view illustrating a non-use state of a conventional printer.
Figure 12:
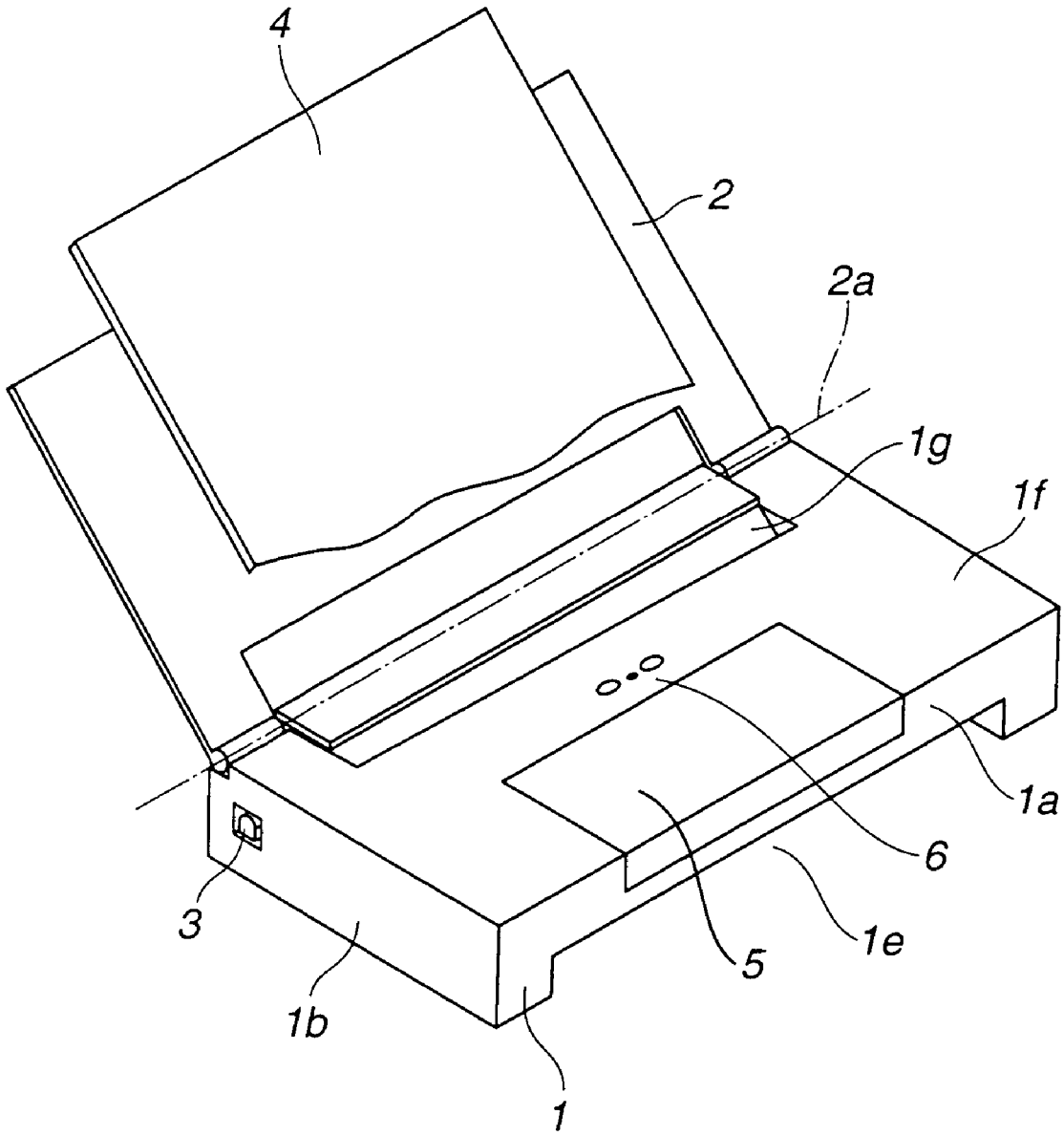
FIG.12 PRIOR ART
FIG. 12 is a perspective view illustrating a state of use of the printer shown in FIG. 11.
Figure 13:
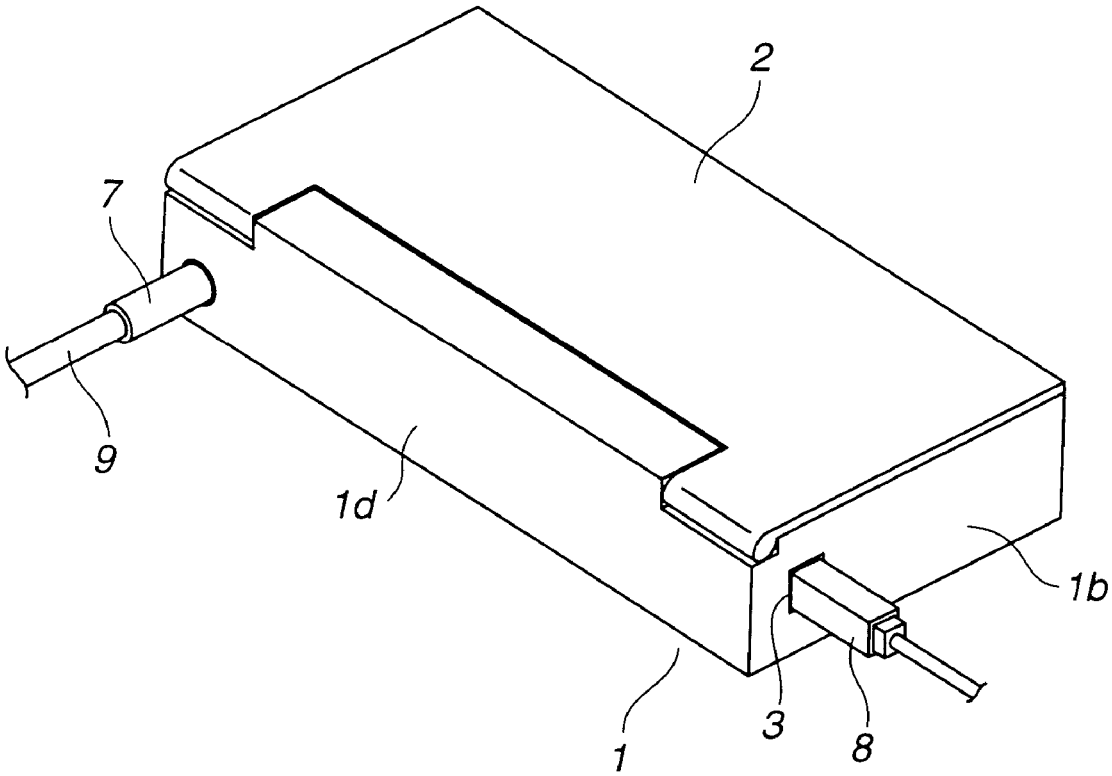
FIG.13 PRIOR ART
FIG. 13 is a perspective view of the printer shown in FIG. 11, as seen from a back-side direction.
Figure 14:
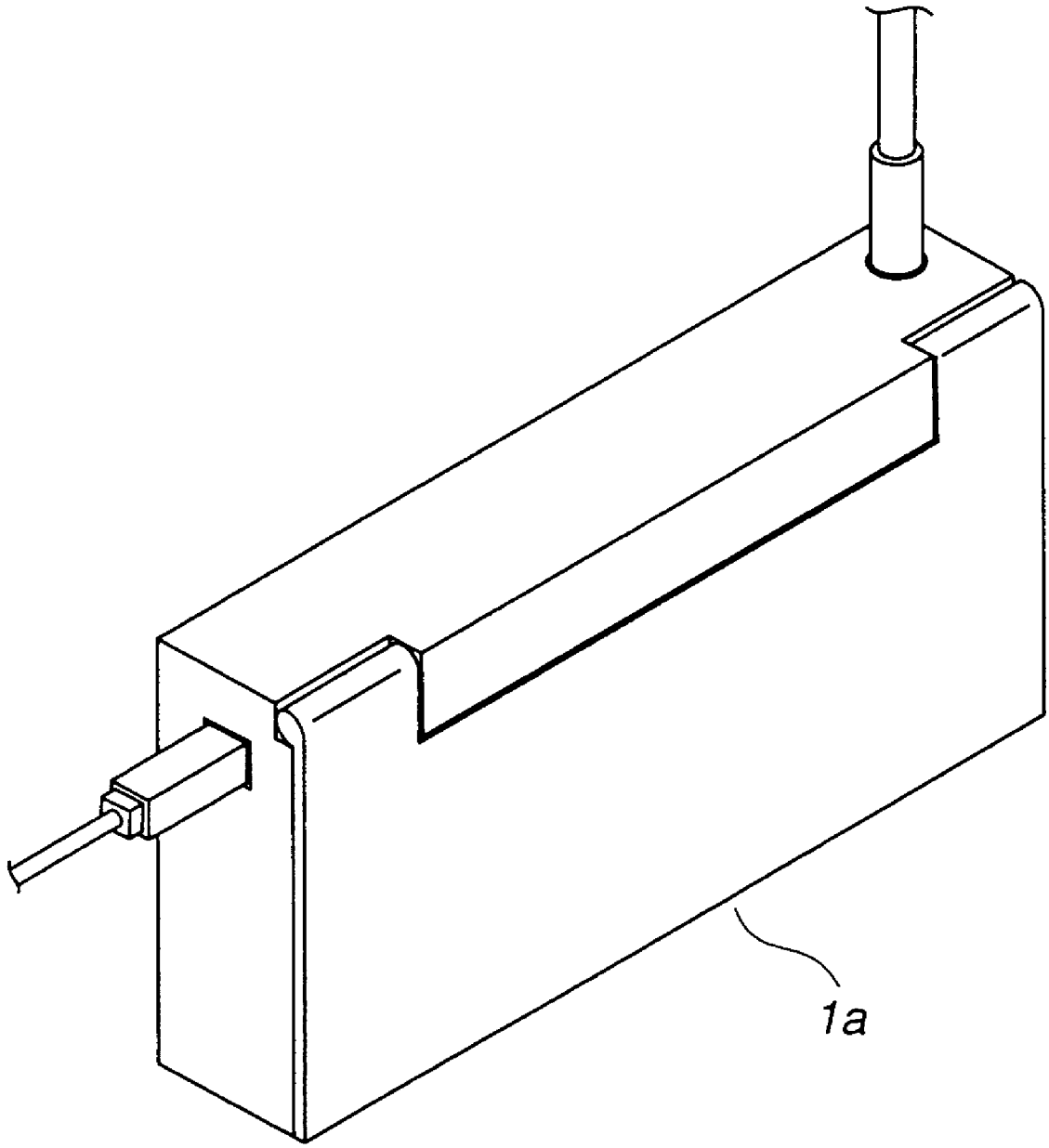
FIG.14 PRIOR ART
FIG. 14 is a perspective view illustrating a vertically accommodated state while inserting cables of the printer shown in FIG. 11.
Figure 15:
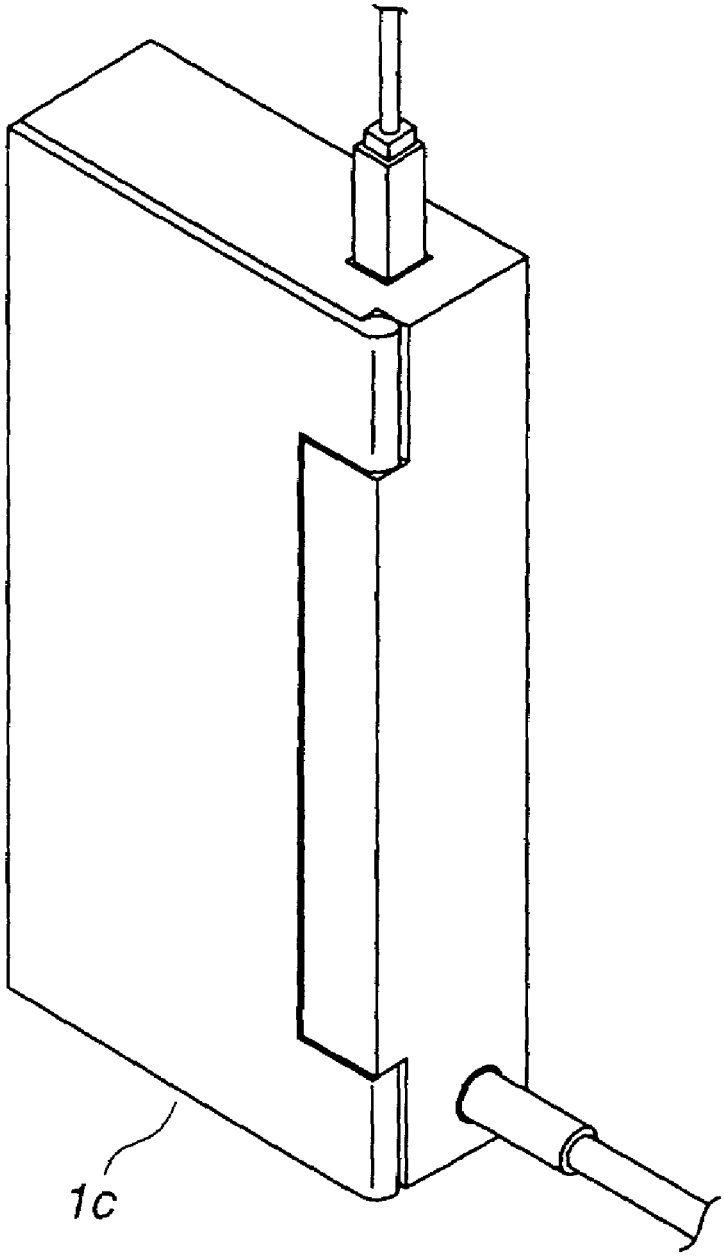
FIG.15 PRIOR ART
FIG. 15 is a perspective view illustrating another vertically accommodated state while inserting cables of the printer shown in FIG. 11.
Figure 16:
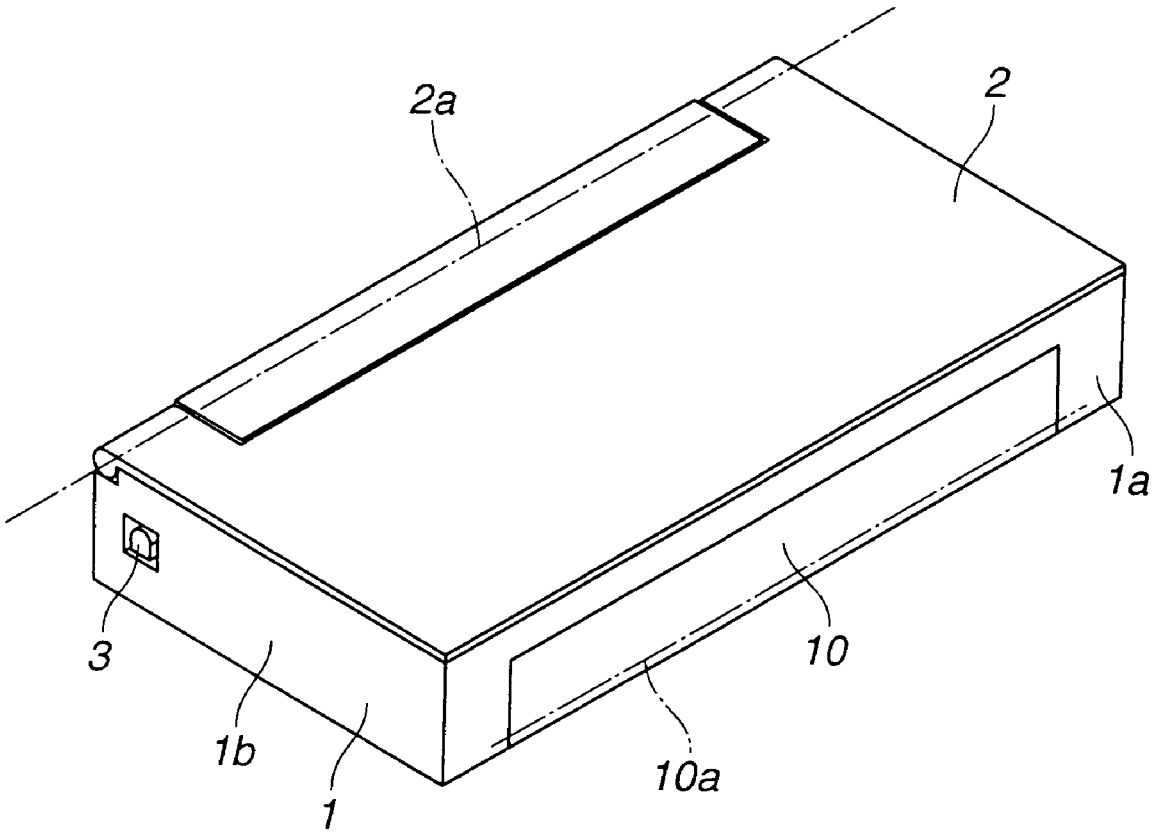
FIG.16 PRIOR ART
FIG. 16 is a perspective view illustrating a non-use state of another conventional printer.
Figure 17:
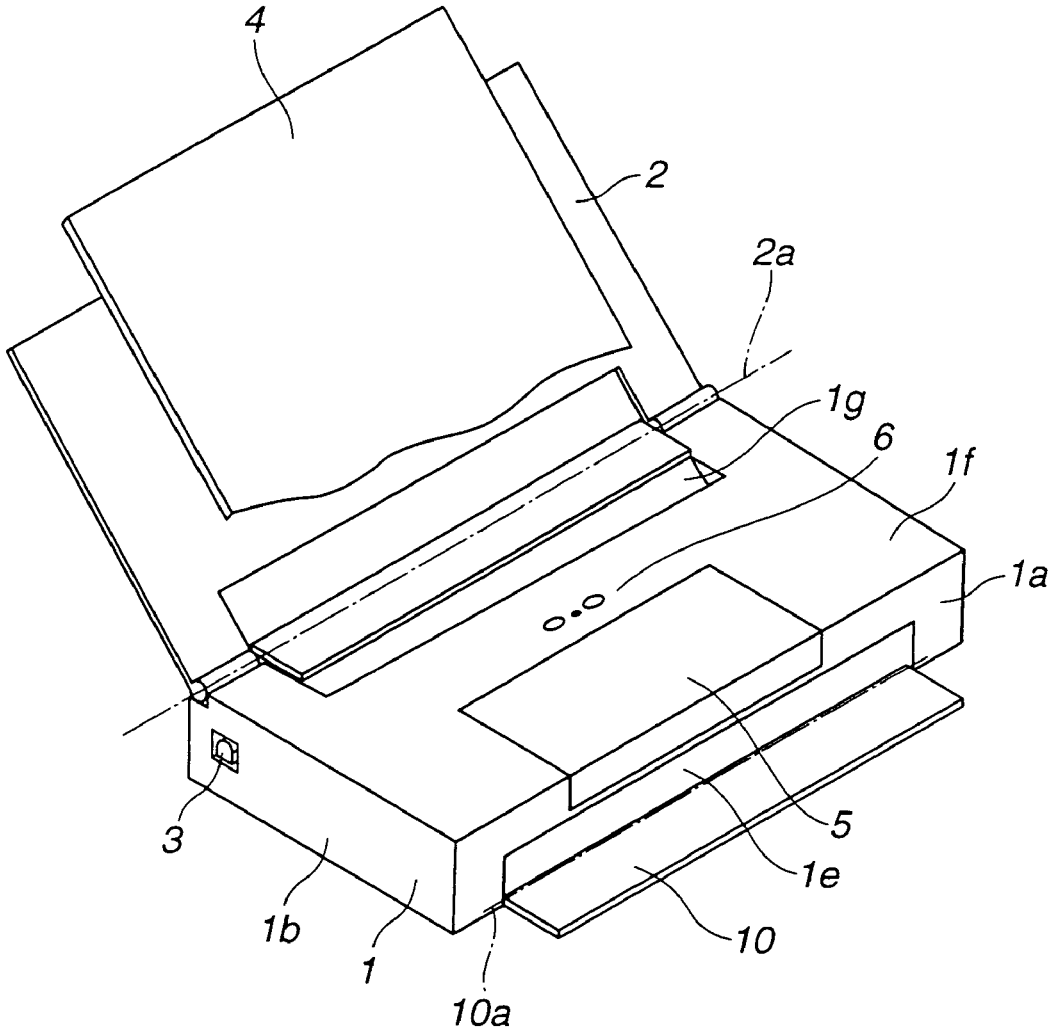
FIG.17 PRIOR ART
FIG. 17 is a perspective view illustrating a state of use of the printer shown in FIG. 16.

FIG. 10 is a perspective view illustrating a case in which the printer is vertically accommodated by inserting cables in the printer main body. Even in a state in which a USB (universal serial bus) cable 823 and a power-supply cable 824 are inserted in the I/F connector 815 and the DC jack 817, respectively, the printer can be accommodated by making the back 800*d* of the printer main body 800 a surface of installation. Since the front 800*a* of the printer main body 800 that becomes the upper surface in this state is covered with the sheet feeding cover 803 and the sheet-discharge-port cover 804, penetration of dust or foreign matter into the printer main body 800 can be prevented. Since troublesome operations, such as disconnection of each cable, and the like, are unnecessary, and the occupied area of the printer main body 800 can be reduced in comparison with the state of use shown in FIG. 3, space saving on a desk can be realized. Furthermore, since cables are disposed so as to follow the surface of installation, the presence of the printer does not cause an obstacle and can provide a visually neat impression.

As described above, since the recording apparatus of the invention has a shell structure comprising a first cover member covering a sheet feeding opening, and a second cover member covering a sheet discharge opening and opened by being linked with the first cover member, dust or foreign matter does not penetrate into the main body of the apparatus when the apparatus is not used, and a sheet jam caused by closing of a sheet-discharge-port cover when the apparatus is used does not occur.

The individual components shown in outline in the drawings are all well known in the recording apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet processing apparatus comprising:

a supply opening for supplying a sheet into a main body;

a discharge opening for discharging the sheet subjected to processing within the main body outside of said apparatus;

a first openable/closable cover member for covering said supply opening;

a second openable/closable cover member for covering said discharge opening; and connection means for maintaining, when both of said first cover member and said second cover member are closed, a state in which said first cover member and said second cover member are closed by connecting said first cover member and said second cover member, wherein said supply opening is disposed at an upper surface of a main body, and said discharge opening is disposed at one side of the main body, wherein said first cover member is rotatable around a first rotation center disposed on the upper surface of the main body, said second cover member is rotatable around a second rotation center disposed at a side of the main body, and, when both of said first cover member and said second cover member are closed, an end portion of said first cover member and an end portion of said second cover member face each other at the side, wherein said connection means comprises a first engaging portion provided at an end portion of said first cover member, and a second engaging portion provided at said second cover member and engageable with said first engaging portion, and wherein, when engagement between said first engaging portion and said second engaging portion is detached, said second cover member opens by its own weight.

2. A sheet processing apparatus according to claim 1, further comprising opening means for opening said second cover member when engagement between said first engaging portion and said second engaging portion is detached.

3. A sheet processing apparatus according to claim 1, wherein said connection means comprises a magnetic material provided at one of said first cover member and said second cover member, and a metal member provided at another one of said first cover member and said second cover member, and connects said first cover member and said second cover member by attraction of said metal member by said magnetic material.

4. A sheet processing apparatus according any one of claims 1, 2, and 3, wherein said sheet processing apparatus performs recording on a sheet supplied from said supply opening using recording means, and discharges the sheet on which the recording has been performed from said discharge opening.

5. A sheet processing apparatus according to claim 4, wherein said recording means comprises an ink-jet recording head.

* * * * *

UNITED STATES PATENT AND TRADEMARK OFFICE

CERTIFICATE OF CORRECTION

PATENT NO. : 6,969,169 B2
APPLICATION NO. : 10/660622
DATED : November 29, 2005
INVENTOR(S) : Yasufumi Tanaami et al.

It is certified that error appears in the above-identified patent and that said Letters Patent is hereby corrected as shown below:

Column 10:

Line 57, "any" should read --to any--.

Signed and Sealed this

Twenty-second Day of August, 2006

JON W. DUDAS
*Director of the United States Patent and Trademark Office*